US011809125B2

(12) United States Patent
Djayaputra et al.

(10) Patent No.: US 11,809,125 B2
(45) Date of Patent: Nov. 7, 2023

(54) SAFETY MECHANISM FOR PRINTING APPARATUS

(71) Applicant: Hand Held Products, Inc., Charlotte, NC (US)

(72) Inventors: David Pratama Djayaputra, Singapore (SG); Florante Go, Singapore (SG); Sébastien Michel Marie Joseph D'Armancourt, Singapore (SG); Fong Yin Lau, Singapore (SG)

(73) Assignee: Hand Held Products, Inc., Charlotte, NC (US)

( * ) Notice: Subject to any disclaimer, the term of this patent is extended or adjusted under 35 U.S.C. 154(b) by 0 days.

(21) Appl. No.: 17/651,617

(22) Filed: Feb. 18, 2022

(65) Prior Publication Data

US 2022/0171326 A1 Jun. 2, 2022

Related U.S. Application Data

(63) Continuation of application No. 17/303,443, filed on May 28, 2021, now Pat. No. 11,287,774, which is a (Continued)

(51) Int. Cl.
*G03G 21/16* (2006.01)
*G03G 15/04* (2006.01)

(52) U.S. Cl.
CPC ... *G03G 21/1666* (2013.01); *G03G 15/04072* (2013.01); *G03G 2221/1687* (2013.01)

(58) Field of Classification Search
CPC ..... G03G 21/1666; G03G 15/04072; G03G 2221/1687; G03G 21/1619;
(Continued)

(56) References Cited

U.S. PATENT DOCUMENTS 5,237,340 A * 8/1993 Nelson ..... G03G 21/1623 347/135
5,812,180 A 9/1998 Masuda et al.
(Continued)

FOREIGN PATENT DOCUMENTS

CN 101008807 A 8/2007
CN 202947750 U 5/2013
(Continued)

OTHER PUBLICATIONS

CN Notice of Allowance dated Sep. 20, 2022 for CN Application No. 202110182836.
(Continued)

*Primary Examiner* — Sandra Brase
(74) *Attorney, Agent, or Firm* — Alston & Bird LLP

(57) ABSTRACT

Example safety mechanisms for example printing apparatuses are provided. An example printing apparatus may include at least one linear guide disposed on a first surface of a back-spine section of a printer body and a top chassis portion coupled to the at least one linear guide. In some examples, the top chassis portion may include a laser safety casing. In some examples, the laser safety casing may comprise a laser module configured to emit a laser beam along a laser path and a safety cover that is moveable to a first cover position intersecting the laser path.

20 Claims, 13 Drawing Sheets

Related U.S. Application Data continuation of application No. 16/786,722, filed on Feb. 10, 2020, now Pat. No. 11,048,205.

(58) Field of Classification Search

CPC ..... G03G 21/1623; G03G 21/1628; G03G 2221/1636; G03G 2221/1678; B41J 29/02; B41J 29/12; B41J 29/13

See application file for complete search history.

(56) References Cited

U.S. PATENT DOCUMENTS

| | | | | |
|---|---|---|---|---|
| 6,504,165 | B1 | 1/2003 | Furutoh | |
| 2004/0008246 | A1 | 1/2004 | Shim | |
| 2004/0047665 | A1 | 3/2004 | DeVore et al. | |
| 2006/0139405 | A1 | 6/2006 | Nellen | |
| 2006/0269298 | A1 | 11/2006 | Park | |
| 2007/0177000 | A1 | 8/2007 | Lee | |
| 2009/0169249 | A1* | 7/2009 | Watanabe | G03G 21/1633 399/114 |
| 2012/0120459 | A1 | 5/2012 | Ono | |
| 2015/0130341 | A1* | 5/2015 | Azami | G03G 21/1619 312/333 |
| 2016/0062305 | A1* | 3/2016 | Kobayashi | G03G 21/1623 399/9 |
| 2017/0225496 | A1 | 8/2017 | Golchewski et al. | |
| 2017/0282614 | A1 | 10/2017 | Lutz et al. | |
| 2020/0209799 | A1 | 7/2020 | Isobe | |

FOREIGN PATENT DOCUMENTS

| | | | |
|---|---|---|---|
| CN | 103888122 | A | 6/2014 |
| CN | 106896333 | A | 6/2017 |
| CN | 108027488 | A | 5/2018 |
| EP | 2944475 | A1 | 11/2015 |
| JP | H01-114869 | A | 5/1989 |
| JP | 11-014869 | A | 1/1999 |
| JP | 2002-356004 | A | 12/2002 |
| JP | 2015-114578 | A | 6/2015 |

OTHER PUBLICATIONS

English translation of CN Notice of Allowance dated Sep. 20, 2022 for CN Application No. 202110182836.

U.S. Appl. No. 17/303,443, filed May 28, 2021, now U.S. Pat. No. 11,287,774, Issued.

U.S. Appl. No. 16/786,722, filed Feb. 10, 2020, now U.S. Pat. No. 11,048,205, Issued.

European Search Report and Search Opinion Received for EP Application No. 21155306.0, dated Jun. 30. 2021, 8 pages.

List of references dated Nov. 19, 2021 for U.S. Appl. No. 17/303,443.

List of references dated Sep. 25, 2020 for U.S. Appl. No. 16/786,722.

Non-Final Rejection dated Sep. 25, 2020 for U.S. Appl. No. 16/766,722.

Notice of Allowance and Fees Due (PTOL-85) dated Mar. 3, 2021 for U.S. Appl. No. 16/786,722.

Notice of Allowance and Fees Due (PTOL-85) dated Nov. 19, 2021 for U.S. Appl. No. 17/303,443.

CN Office Action dated Apr. 8, 2022 for CN Application No. 202110182836, 7 page(s).

English Translation of CN Office Action dated Apr. 8, 2022 for CN Application No. 202110182836, 12 page(s).

* cited by examiner

SAFETY MECHANISM FOR PRINTING APPARATUS

CROSS-REFERENCE TO RELATED APPLICATIONS

This application is a continuation of U.S. patent application Ser. No. 17/303,443, filed May 28, 2021, which is a continuation of and claims priority to U.S. patent application Ser. No. 16/786,722, filed Feb. 10, 2020 (now U.S. Pat. No. 11,048,205, issued Jun. 29, 2021). The entire disclosure of each application is incorporated herein by reference.

TECHNICAL FIELD

The present application relates generally to laser printers.

BACKGROUND

Laser printing refers to a printing process that may produce texts, graphics and/or the like on a print media utilizing laser technology. For example, a laser printer may repeatedly pass a laser beam (or multiple laser beams) over a negatively charged cylinder (for example, a selenium-coated drum) based on the to-be-printed texts, graphics and/or the like, such that the negatively charged cylinder may selectively collect electrically charged powdered ink (for example, from a toner), and that the ink may be heated to permanently fuse texts, graphics and/or the like on the print media.

When applying a laser beam in laser printing, safety is always a concern. For example, a laser beam not handled properly may accidentally be in direct or indirect contact with a human (for example, a user of the laser printer), and may produce serious injuries to the human (such as burned cornea, blindness, burned skin and/or laceration). For safety purposes, lasers may be categorized into classes based on their safety risks for causing laser-related accidents and injuries (such as those injuries to a human described above). The higher the classification of the laser, the higher the power that the laser may have, and the higher the safety risk that it may pose. For example, a class 1 laser may emit a laser beam less than 0.39 milliwatts, and a class 4 laser may emit a laser beam of 500 milliwatts or more. A class 1 laser may be considered as having a low safety risk, and a class 4 laser may be considered as having the highest safety risk that may cause severe injuries. A higher classification laser may also pose safety risks such as igniting fire (for example, on the print media) as well as cutting and/or melting mechanical parts.

In some examples, a laser printer may require a high-power laser. Thus, there is a need to provide a safe environment to users of laser printers.

BRIEF SUMMARY

In general, embodiments of the present disclosure provide apparatus, systems, methods, and/or the like.

In accordance with embodiments of the present disclosure, a printing apparatus is provided. The printing apparatus may comprise at least one linear guide disposed on a first surface of a back-spine section of a printer body and a top chassis portion coupled to the at least one linear guide.

In some examples, the top chassis portion may comprise a laser safety casing. In some examples, the laser safety casing may comprise a laser module configured to emit a laser beam along a laser path and a safety cover that is moveable to a first cover position intersecting the laser path.

In some examples, each of at least one linear guide may comprise a corresponding linear rail fastened to the first surface of the back-spine section and a corresponding linear block coupled to the corresponding linear rail. In some examples, the top chassis portion may be fastened to the corresponding linear block.

In some examples, the at least one linear guide may define a travel path for the top chassis portion in a vertical axis. In some examples, the printing apparatus may further comprise a bottom chassis portion fastened to the first surface of the back-spine section. In some examples, the bottom chassis portion may be positioned under the top chassis portion in the vertical axis. In some examples, the bottom chassis portion may be configured to receive print media.

In some examples, the travel path may comprise a bottom point in the vertical axis.

In some examples, the laser safety casing may comprise a cover control mechanism connected to the safety cover. In some examples, the cover control mechanism may cause the safety cover to: translate to the first cover position when the top chassis portion is not positioned at the bottom point, and translate to a second cover position away from the laser path when the top chassis portion is positioned at the bottom point.

In some examples, the cover control mechanism may comprise at least one bias spring connected to the safety cover and the at least one linear guide.

In some examples, when the top chassis portion may be positioned at the bottom point, the at least one bias spring may cause the safety cover to translate to the second cover position. In some examples, when the top chassis portion is not positioned at the bottom point, the at least one bias spring causes the safety cover to translate to the first cover position.

In some examples, the first cover position may intersect the laser path behind a focus lens in a laser travel direction of the laser beam.

In some examples, the first cover position may intersect the laser path behind a reflector lens in a laser travel direction of the laser beam.

In some examples, the laser safety casing may comprise an opening in the laser path. In some examples, the safety cover may overlap with the opening in the first cover position.

In some examples, the bottom chassis portion may comprise a power contact disposed on a top surface of the bottom chassis portion. In some examples, the power contact may be coupled to a power supply unit.

In some examples, the power contact may comprise at least one spring-loaded pin.

In some examples, the top chassis portion may comprise a power receptacle disposed on a bottom surface of the top chassis portion. In some examples, the power receptacle may be coupled to the laser module.

In some examples, when the top chassis portion is positioned at the bottom point of the travel path, the power receptacle of the top chassis portion may be coupled to the power contact of the bottom chassis portion, causing the power supply unit to supply power to the laser module.

In some examples, when the top chassis portion is not positioned at the bottom point of the travel path, the power receptacle of the top chassis portion may not be coupled to the power contact of the bottom chassis portion.

In some examples, the printing apparatus may further comprise at least one platen roller disposed on the first surface of the back-spine section and positioned after the top chassis portion in a print direction of a print media.

In some examples, the at least one platen roller may comprise a top platen roller and a bottom platen roller. In some examples, the print media may travel between the top platen roller and the bottom platen roller in the print direction.

In some examples, the printing apparatus may comprise a printer cover connected to the printer body. In some examples, the printer cover and the printer body may form a printer casing that houses the top chassis portion and comprises an exit slit for a print media.

In some examples, the printing apparatus may comprise at least one brush element disposed on an inner surface of the printer casing. In some examples, the at least one brush element may be positioned after the top chassis portion and before the exit slit in a print direction of the print media.

In some examples, the at least one brush element may comprise a top brush element and a bottom brush element. In some examples, the print media may travel between the top brush element and the bottom brush element in the print direction.

In some examples, the exit slit may comprise at least one guide-way element. In some examples, the printing apparatus may further comprise at least one rib element connected to the at least one guide-way element.

In some examples, the at least one guide-way element may comprise a top guide-way element and a bottom guide-way element. In some examples, the at least one rib element may comprise a top rib element and a bottom rib element. In some examples, the top rib element may be connected to the top guide-way element. In some examples, the bottom rib element may be connected to the bottom guide-way element. In some examples, the print media may travel between the top rib element and the bottom rib element.

In some examples, the exit slit may comprise at least one plate element disposed on an outer surface of the printer casing through a hinge mechanism.

In some examples, the at least one plate element may comprise a top plate element and a bottom plate element. In some examples, the print media may travel between the top plate element and the bottom plate element.

In some examples, the printing apparatus may comprise a latch hook element connected to an outer surface of the top chassis portion through a bias spring. In some examples, the latch hook element may be configured to engage a latch notch element disposed on an outer surface of the bottom chassis portion when the top chassis portion is positioned at the bottom point of the travel path. In some examples, the latch hook element may comprise a magnetic element. In some examples, the bottom chassis portion may comprise a magnetic switch element.

In some examples, the magnetic switch element may be electronically coupled to a power supply unit.

In some examples, the magnetic switch element may be configured to detect a magnetic field strength and, based on the magnetic field strength not exceeding a threshold value, switch off the power supply unit.

In some examples, the printing apparatus may further comprise at least one magnetic element disposed on an inner surface of the printer cover, and at least one magnetic sensing element disposed on an inner surface of the printer body. In some examples, the at least one magnetic sensing element may be configured to generate sensing data indicative of a distance between the at least one magnetic element and the at least one magnetic sensing element.

In some examples, the printing apparatus may further comprise a controller electronically coupled to the at least one magnetic sensing element and a power supply unit. In some examples, the controller may comprise at least one processor and at least one non-transitory memory comprising a computer program code.

In some examples, the at least one non-transitory memory and the computer program code may be configured to, with the at least one processor, cause the controller to: determine whether the distance between the at least one magnetic element and the at least one magnetic sensing element exceeds a threshold value; and in response to determining that the distance exceeds the threshold value, cause the power supply unit to be turned off.

The foregoing illustrative summary, as well as other exemplary objectives and/or advantages of the present disclosure, and the manner in which the same are accomplished, are further explained within the following detailed description and its accompanying drawings.

DETAILED DESCRIPTION OF THE INVENTION

Figure 1A:
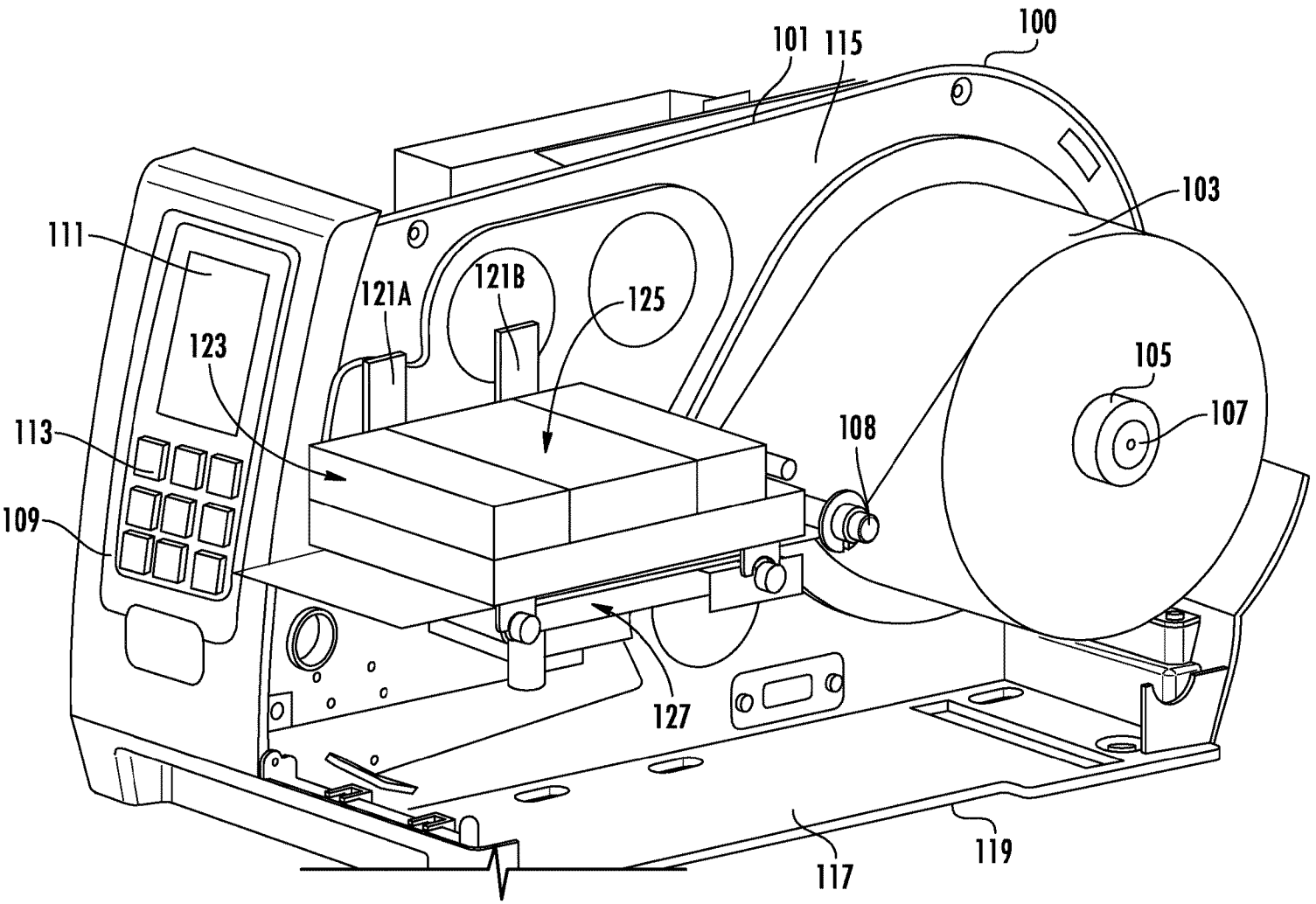
FIG. 1A schematically depicts an example perspective view of an example laser printer including a top chassis portion and a bottom chassis portion according to various embodiments of the present disclosure.

Some embodiments of the present disclosure will now be described more fully hereinafter with reference to the accompanying drawings, in which some, but not all embodiments of the disclosure are shown. Indeed, these disclosures may be embodied in many different forms and should not be construed as limited to the embodiments set forth herein; rather, these embodiments are provided so that this disclosure will satisfy applicable legal requirements. Like numbers refer to like elements throughout.

Unless the context requires otherwise, throughout the specification and claims which follow, the word "comprise" and variations thereof, such as, "comprises" and "comprising" are to be construed in an open sense, that is as "including, but not limited to."

Reference throughout this specification to "one embodiment" or "an embodiment" means that a particular feature, structure or characteristic described in connection with the embodiment is included in at least one embodiment. Thus, the appearances of the phrases "in one embodiment" or "in an embodiment" in various places throughout this specification are not necessarily all referring to the same embodiment. Furthermore, one or more particular features, structures, or characteristics from one or more embodiments may be combined in any suitable manner in one or more other embodiments.

The word "example" or "exemplary" is used herein to mean "serving as an example, instance, or illustration." Any implementation described herein as "exemplary" is not necessarily to be construed as preferred or advantageous over other implementations.

If the specification states a component or feature "may," "can," "could," "should," "would," "preferably," "possibly," "typically," "optionally," "for example," "often," or "might" (or other such language) be included or have a characteristic, that a specific component or feature is not required to be included or to have the characteristic. Such component or feature may be optionally included in some embodiments, or it may be excluded.

The term "electronically coupled," "electronically coupling," "electronically couple," "in communication with," "in electronic communication with," or "connected" in the present disclosure refers to two or more components being connected (directly or indirectly) through wired means (for example but not limited to, system bus, wired Ethernet) and/or wireless means (for example but not limited to, Wi-Fi, Bluetooth, ZigBee), such that data and/or information may be transmitted to and/or received from these components.

As described above, a laser printer may require a high-power laser. A high-power laser that normally would be classified as a class 3 or a class 4 laser (potentially causing severe injuries when directly in contact with eye or skin) may be re-classified into a class 1 laser (potentially causing low risk) if appropriate safety design is implemented. As such, various examples of the present disclosure may provide example safety mechanism for improving safety in laser printing and reducing risks of laser-related accidents and/or injures.

The terms "print media," "physical print media," "paper," and "labels" refer to tangible, substantially durable physical material onto which text, graphics, images and/or the like may be imprinted and persistently retained over time. Physical print media may be used for personal communications, business communications, and/or the like to convey prose expression (including news, editorials, product data, academic writings, memos, and many other kinds of communications), data, advertising, fiction, entertainment content, and illustrations and pictures. Physical print media may be generally derivatives of wood pulp or polymers, and includes conventional office paper, clear or tinted acetate media, news print, envelopes, mailing labels, product labels, and other kinds of labels. Thicker materials, such as cardstock or cardboard may be included as well. More generally, print media may be used to receive ink, dye, or toner, or may be a media whose color or shading can be selectively varied (for example, through selective application of heat, light, or chemicals) to create a persistent visual contrast (in black and white, shades of gray, and/or colors) that can be perceived by the human eye as texts, images, shapes, symbols, or graphics. In exemplary embodiments discussed throughout this document, reference may be made specifically to "paper" or "labels;" however, the operations, system elements, and methods of such exemplary applications may be applicable to media other than or in addition to the specifically mentioned "paper" or "labels."

The terms "printer" and "printing apparatus" refer to a device that may imprint texts, images, shapes, symbols, graphics, and/or the like onto print media to create a persistent, human-viewable representation of the corresponding texts, images, shapes, symbols, graphics, and/or the like. Printers may include, for example, laser printers. Example components of an example laser printer are illustrated and described in connection with FIG. 1A and FIG. 1B.

Figure 1B:
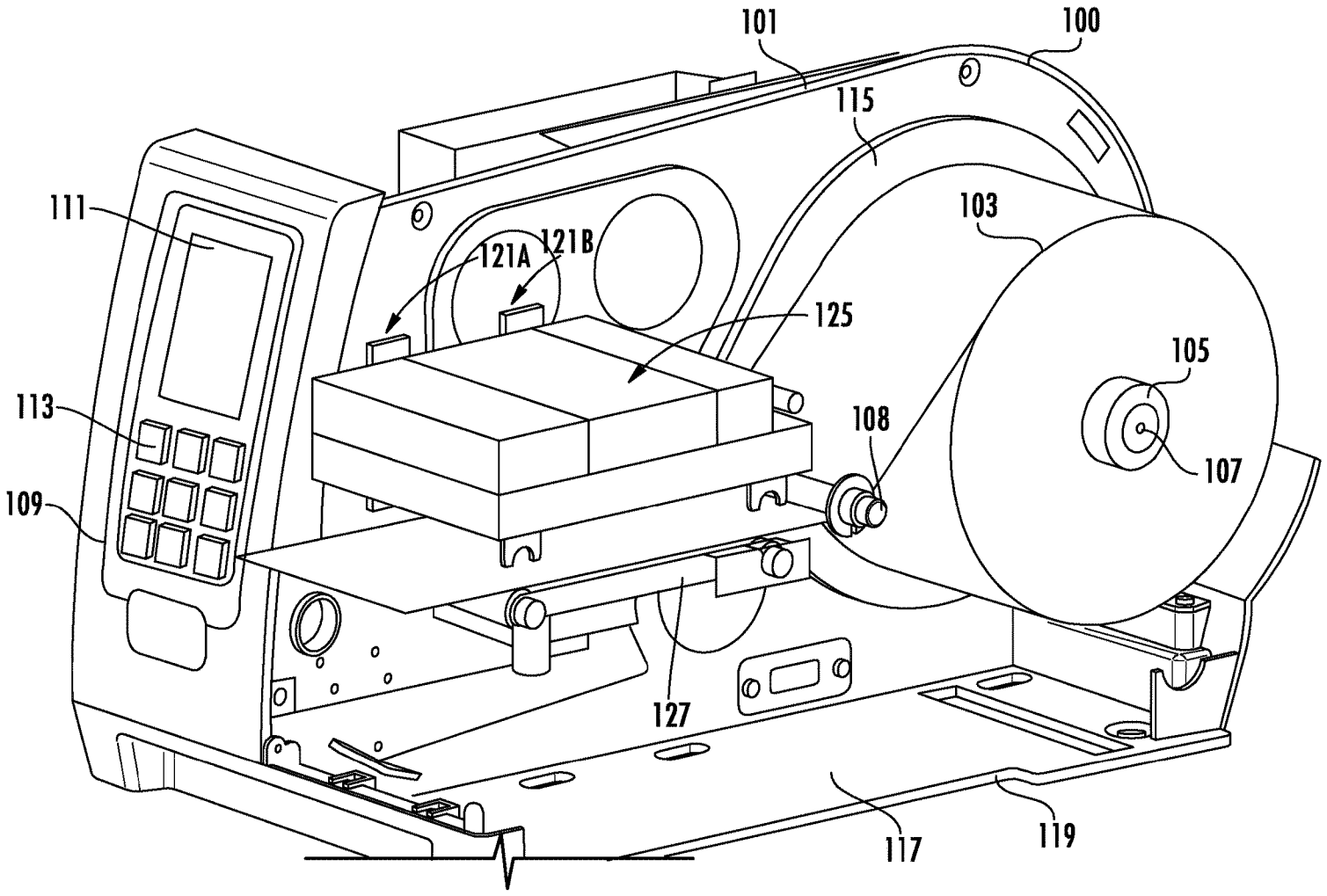
FIG. 1B schematically depicts another example perspective view of an example laser printer including a top chassis portion and a bottom chassis portion according to various embodiments of the present disclosure.

Referring now to FIG. 1A and FIG. 1B, example components of an example laser printer are at least partially shown. In particular, FIG. 1A and FIG. 1B illustrate example components of an example printer body 100. While not shown in FIG. 1A and FIG. 1B, the example laser printer may comprise a power source, as well as a printer cover for housing various components in the interior of the example laser printer. An example printer cover is further illustrated and described in connection with at least FIG. 10.

In the example shown in FIG. 1A, the example printer body 100 may include a media supply roll 103. The media supply roll 103 may comprise print media that may be wound on the media supply spool 105. In the example shown in FIG. 1A, the example printer body 100 may comprise a media supply spindle 107, and the media supply spool 105 may be configured to be disposed on media supply spindle 107.

In some examples, the example printer body 100 may comprise a media guiding spindle 108, which may be positioned to guide the print media from the media supply roll 103 to travel in a print direction along a print path within the example printer body 100. In some examples, after texts, graphics, images and/or the like (as applicable) are imprinted on the print media, the print media may exit from the example printer body 100 from an exit slit. Example diagrams illustrating example exit slits include, but not limited to, those shown and described in at least FIG. 5, FIG. 6, FIG. 7A, and/or FIG. 7B.

In some examples, the example printer body 100 may comprise one or more motors for rotating the media supply spool 105 disposed on the media supply spindle 107 in a forward rotational direction, causing the print media to travel in a print direction. Additionally, or alternatively, the one or more motors may rotate the media guiding spindle 108 in a forward rotational direction, causing the print media to travel in a print direction. Additionally, or alternatively, the one or more motors may rotate the media supply spool 105 and/or the media guiding spindle 108 in a backward rotational direction.

In some examples, the media supply spindle 107 and/or the media guiding spindle 108 may be eliminated, and the print media may be fed into the example printer body 100 through an opening slit, and may exit from the example printer body 100 through an exit slit.

In some examples, the example printer body 100 may include a graphical user interface (GUI) 109 for enabling communications between a user and the example laser printer. The GUI 109 may be communicatively coupled to other components of the example laser printer for displaying visual and/or auditory information and/or for receiving information from the user (e.g., typed, touched, spoken, etc.).

In the example shown in FIG. 1A, the example printer body 100 may include the GUI 109 with, for example, a display 111 and a keypad 113. The display 111 may be configured to display various information associated with the example laser printer. The keypad 113 may comprise function buttons that may be configured to perform various typical printing functions (e.g., cancel print job, advance print media, and the like) or be programmable for the execution of macros containing preset printing parameters for a particular type of print media. The GUI 109 may be supplemented or replaced by other forms of data entry or printer control, such as a separate data entry and control module linked wirelessly or by a data cable operationally coupled to a computer, a router, or the like.

In some examples, the GUI 109 may be electronically coupled to a controller for controlling operations of the example laser printer, in addition to other functions. An example block diagram illustrating an example controller is illustrated and described in connection with at least FIG. 9.

While FIG. 1A illustrates an example GUI 109, it is noted that the scope of the present disclosure is not limited to the example GUI 109 as shown in FIG. 1A. In some embodiments, the user interface may be different from the one depicted in FIG. 1A. In some embodiments, there may not be a user interface.

Referring back to FIG. 1A, the example printer body 100 may comprise a back-spine section 101. In some examples, the back-spine section 101 may be made of material having rigid characteristics, such as aluminum alloy, stainless steel, and/or the like. In some examples, the back-spine section 101 may comprise a first surface 115. The first surface 115 may be in a perpendicular arrangement with a surface 117 of a printer base 119.

In some examples, at least one linear guide may be disposed on a surface of an example back-spine section of an example printer body. In some examples, each of at least one linear guide may comprise a corresponding linear rail and a corresponding linear block. In some examples, the corresponding linear rail may be fastened to the first surface of the back-spine section through, for example, bolts, screws, and/or the like. In some examples, the corresponding linear block may be coupled to the corresponding linear rail through, for example, ball bearings, rollers, and/or the like, such that the corresponding linear block may move and/or slide along the corresponding linear rail. Example linear guides may include, but not limited to, rolling element linear motion bearing guides, sliding contact linear motion bearing guides, and/or the like.

In some examples, an example top chassis portion of an example laser printer may be coupled to the at least one linear guide. For example, the example top chassis portion may be fastened to the corresponding linear block of the at least one linear guide through, for example, bolts, screws, and/or the like.

For example, in FIG. 1A, a first linear guide 121A and a second linear guide 121B may be disposed on the first surface 115. The first linear guide 121A may, for example, comprise a linear rail fastened to the first surface 115 of the back-spine section 101, as well as a corresponding linear block that is coupled to the linear rail and movable along the linear rail. The top chassis portion 123 may be coupled to the first linear guide 121A through the corresponding linear block of the first linear guide 121A, such that the top chassis portion 123 may be moveable along the linear rail of the first linear guide 121A. Additionally, or alternatively, the second linear guide 121B may comprise a linear rail disposed on the first surface 115 of the back-spine section 101 and a corresponding linear block. The top chassis portion 123 may be coupled to the second linear guide 121B through the corresponding linear block of the second linear guide 121B, such that the top chassis portion 123 may be moveable along the linear rail of second linear guide 121B.

In some examples, as the top chassis portion 123 moves along the linear rail(s) of first linear guide 121A and/or the second linear guide 121B, the first linear guide 121A and/or the second linear guide 121B may define a travel path for the top chassis portion 123 in a vertical axis. For example, the travel path may correspond to the linear rail(s) of the first linear guide 121A and/or the second linear guide 121B, which may define the vertical axis in a parallel arrangement to the linear rail(s).

In some examples, an example laser printer may comprise a bottom chassis portion fastened to an example first surface of an example back-spine section. In some examples, the example bottom chassis portion may be positioned under the example top chassis portion in the vertical axis and may be configured to receive print media. For example, as shown in FIG. 1A, a bottom chassis portion 127 may be positioned under the top chassis portion 123 in the vertical axis as defined by the travel path of the top chassis portion 123. The bottom chassis portion 127 may be configured to receive print media from the media supply roll 103.

In some examples, as the top chassis portion 123 moves along its corresponding travel path, the top chassis portion 123 may reach and/or be positioned a bottom point of the travel path in the vertical axis. When the top chassis portion 123 is positioned at the bottom point, the top chassis portion 123 may be positioned at the lowest point along the travel path, and the top chassis portion 123 may be closest to the bottom chassis portion 127. For example, FIG. 1A illustrates an example of the top chassis portion 123 being positioned at the bottom point of the travel path.

In some examples, the top chassis portion 123 may comprise a laser safety casing 125. The laser safety casing 125 may comprise a laser module and a safety cover. Examples of laser module and safety cover are illustrated and described in connection with at least FIGS. 2A and 2B.

In some examples, the laser module of the laser safety casing 125 may emit a laser beam when the laser module is powered on and/or activated. In some examples, the laser safety casing 125 may comprise an opening, and the laser beam may travel through the opening and along a laser path to activate a negatively charged cylinder to selectively collect electrically charged powdered ink, causing ink to be heated to permanently fuse texts, graphics and/or the like on the print media received by the bottom chassis portion 127. In some examples, the top chassis portion 123 may comprise the negatively charged cylinder.

While FIG. 1A illustrates that the top chassis portion 123 is positioned on the bottom point of the travel path, the top chassis portion 123 may move up along the travel path (as described above). For example, during circumstances such as media insertion, media change, maintenance, calibration, component change, and/or the like, the top chassis portion 123 may need to be lifted-up. Referring now to FIG. 1B, an example situation where the top chassis portion 123 is moved up and away from the bottom point of the travel path is illustrated. In some examples, when the top chassis portion 123 is moved up, a potential laser beam may refract from the print media and/or other component of the example laser printer. Accordingly, various examples of the present disclosure provide example safety mechanisms that may prevent and/or reduce refracted laser beam from being in contact with a user, as described in detail herein.

Figure 2A:
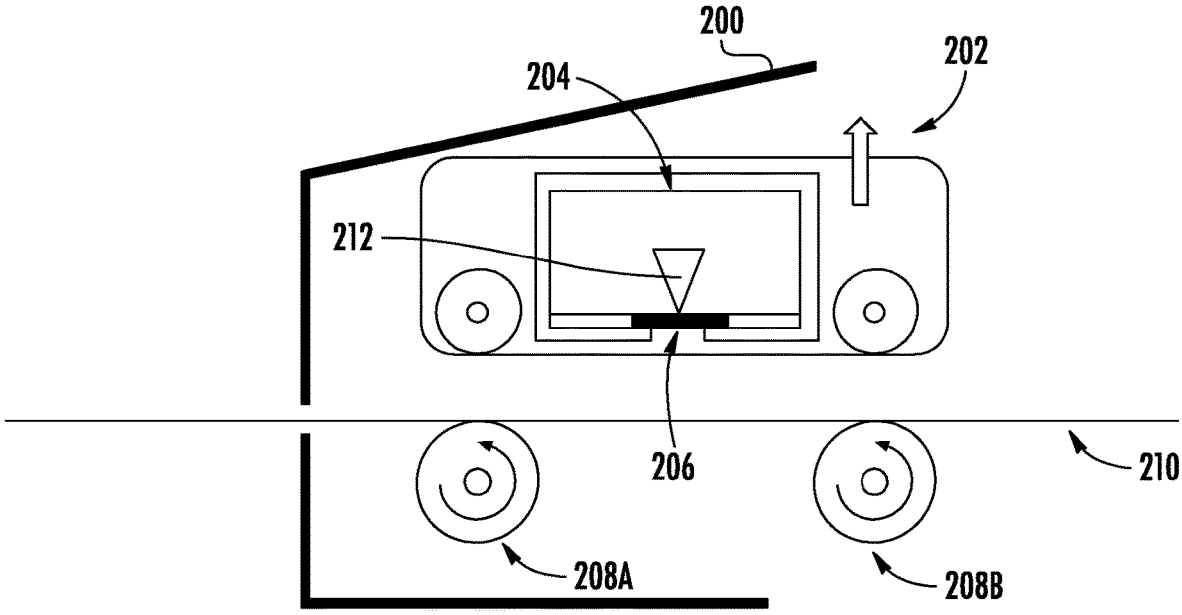
FIG. 2A schematically depicts an example block diagram of an example laser printer where a safety cover may be in a first cover position according to various embodiments of the present disclosure.
Figure 2B:
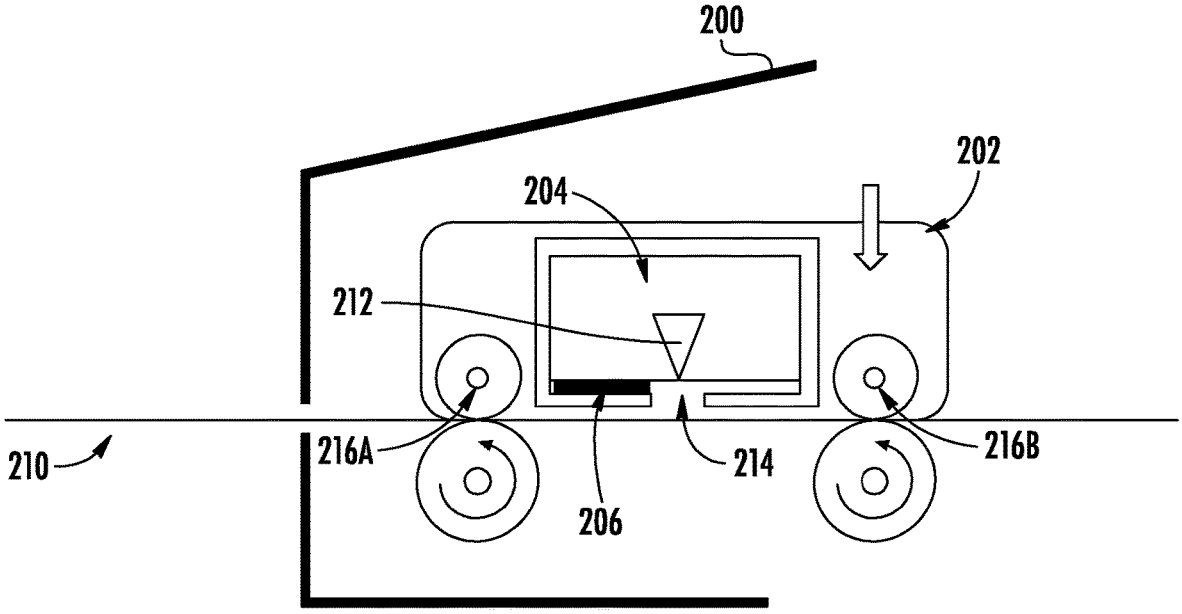
FIG. 2B schematically depicts another example block diagram of an example laser printer where a safety cover may be in a second cover position according to various embodiments of the present disclosure.
Figure 3:
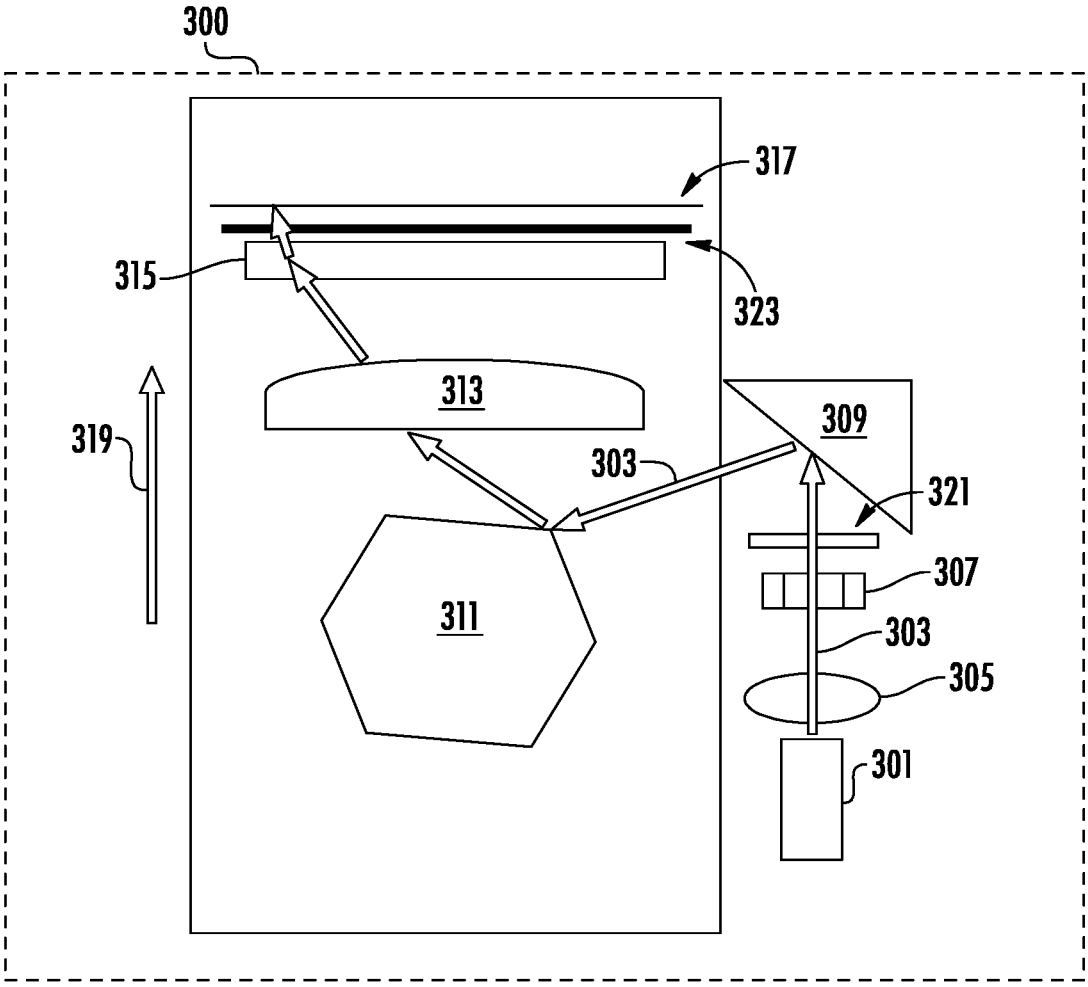
FIG. 3 schematically depicts an example block diagram showing an example laser safety casing and example locations of a safety cover according to various embodiments of the present disclosure.

Referring now to FIG. 2A, FIG. 2B, and FIG. 3, example safety mechanisms for a printing apparatus are illustrated. In particular, FIG. 2A, FIG. 2B, and FIG. 3 illustrate an example safety mechanism where one or more safety covers may be implemented.

Referring now to FIG. 2A, an example block diagram of an example laser printer 200 is illustrated. In particular, the laser printer 200 may comprise a top chassis portion 202 and a laser safety casing 204, similar to the top chassis portion 123 and the laser safety casing 125, respectively, described above in connection with FIG. 1A and FIG. 1B.

In the example shown in FIG. 2A, the laser safety casing 204 may comprise a safety cover 206. In some examples, the safety cover 206 may be moveable. For example, FIG. 2A illustrates that the safety cover 206 is at a first cover position that intersects a laser path of a laser emitted by the laser module 212, therefore blocking the laser beam from escaping from the laser safety casing 204.

In some examples, the safety cover 206 may be made of a material that may comply with industrial standard requirement for laser absorption. For example, the safety cover 206 may have black or matte-black color properties. Additionally, or alternatively, the safety cover 206 may be made of material such as, but not limited to, carbon, polyethylene, and/or the like.

In some examples, the laser safety casing 204 may comprise a cover control mechanism connected to the safety cover 206, which may cause the safety cover 206 to translate between a first cover position and a second cover position based on, for example, the position of the top chassis portion 202. For example, the cover control mechanism may cause the safety cover 206 to translate to the first cover position when the top chassis portion 202 is not positioned at the bottom point of the travel path (as described above), and the safety cover 206 may block the laser beam from escaping from the laser safety casing 204, as illustrated in FIG. 2A.

Additionally, or alternatively, the control mechanism may cause the safety cover 206 to translate to a second cover position away from the laser path when the top chassis portion is positioned at the bottom point of the travel path of the top chassis portion. Referring now to FIG. 2B, such an example is illustrated. As shown in FIG. 2B, the safety cover 206 may be translated to the second cover position that does not intersect with the laser path and/or block the laser beam when the top chassis portion 202 is positioned at the bottom point of the travel path. In some examples, when the top chassis portion 202 is positioned at the bottom point, the laser printer 200 may power on or activate the laser module to cause texts, graphics and/or the like to be printed on a print media 210. For example, the driver rollers 208A and 208B and/or the pinch rollers 216A and 216B may cause the print media to travel along a print path in a print direction. In some examples, the control mechanism may cause the safety cover 206 to translate to the second cover position when the top chassis portion 202 is locked-down at the bottom point and is in a "ready to print" state.

In some examples, the control mechanism may comprise one or more bias springs. For example, the cover control mechanism may comprise at least one bias spring connected to the safety cover 206 and to the at least one linear guide (to which the top chassis portion 202 is coupled as described above in connection with FIG. 1A and FIG. 1B). In some examples, the at least one bias spring may be in a compressed or relaxed state that is in synchronization with the down or up movement of the top chassis portion 202 along the at least one linear guide.

For example, when the top chassis portion 202 is positioned at the bottom point of the travel path, the at least one bias spring may be in a compressed state, and may cause the safety cover 206 to translate to the second cover position (for example, as shown in FIG. 2B). Additionally, or alternatively, when the top chassis portion 202 is not positioned at the bottom point of the travel path, the at least one bias spring may be in a relaxed state, and may cause the safety cover 206 to translate to the first cover position (for example, as shown in FIG. 2A).

As shown in FIG. 2A and FIG. 2B, the safety cover 206 may be positioned on an opening of the laser safety casing 204. For example, when the safety cover 206 is translated to the first cover position, the safety cover 206 may completely block the opening 214 of the laser safety casing 204, and may absorb any potential laser beam leakage.

It is noted that the scope of the present disclosure is not limited to the safety cover 206 being positioned on the opening of the laser safety casing. In some examples, the safety cover 206 may be positioned in other locations within or outside the laser safety casing 204, examples of which are illustrated and described in connection with FIG. 3.

Referring now to FIG. 3, an example block diagram of an example laser safety casing 300 is illustrated. In the example shown in FIG. 3, the example laser safety casing 300 may comprise a laser diode 301 that may be configured to generate a laser beam. The laser beam may travel along a laser path 303. For example, the laser beam may travel along the laser path 303 through a collimating lens 305 and subsequently through a focus lens 307, where the laser beam may be collimated and focused into a single-array of line.

The laser beam may be reflected by the reflector 309, and subsequently be reflected by a rotating mirror 311. The laser beam may travel along the laser path 303 through a scanning lens 313, and subsequently, may travel through the reflector lens 315 to arrive at, for example, an opening 317 of the laser safety casing 300. In some examples, the opening 317 may correspond to a print line for print media as the print media travels in the direction as indicated by the arrow 319.

In various examples, one or more example safety covers may be mounted on various locations. For example, an example safety cover may be mounted behind the focus lens 307, such that the first cover position 321 may intersect with the laser path 303 behind the focus lens 307 in a laser travel direction of the laser beam. Additionally, or alternatively, an example safety cover may be mounted behind the reflector lens 315, such that the first cover position 323 may intersect with the laser path 303 behind the reflector lens 315 in a laser travel direction of the laser beam. Additionally, or alternatively, the safety cover may be mounted to overlap with the opening 317 of the laser safety casing 300 when the safety cover is in the first cover position. Additionally, or alternatively, the safety cover may be mounted outside the laser safety casing.

While FIG. 3 and the description above illustrate example locations of the safety cover, it is noted that the scope of the present disclosure is not limited to these locations only. Additionally, or alternatively, the safety cover may be mounted on other locations, without deviating from the scope of the present disclosure.

Further, while FIG. 2A, FIG. 2B, and FIG. 3 illustrate example safety mechanisms for a printing apparatus, it is noted that the scope of the present disclosure is not limited to these mechanisms only. Additionally, or alternatively, other mechanisms may be implemented to, for example, improve safety in handling a printing apparatus.

For example, an example printing apparatus may implement one or more mechanical mechanisms that allow the laser module to be safely disassembled from the top chassis portion during service, repair and/or other circumstances where the laser module may need to be taken out from the top chassis portion. Such example mechanical mechanisms may be embodied in a variety of different ways. As an example, the laser module may be removably attached to an inner surface of the top chassis portion through removable attachment mechanisms, such as, but not limited to, one or more pins disposed on the bottom surface of the laser module and one or more holes on the inner surface of the top chassis portion that may receive the one or more pins. The laser module may also comprise an enclosure having an opening that allows a laser beam to travel through, and a moveable cover mounted on the outer surface of the enclosure. The moveable cover may translate to a first cover position that covers the opening when the laser module is removed from the top chassis portion. For example, the moveable cover may be connected to the one or more pins through a bias spring. When the one or more holes receive the one or more pins, the bias spring may be in a compressed state and may cause the cover to translate to a second cover position (similar to those described above). When the one or more pins are released from the one or more holes, the bias spring may be in a relaxed state and may cause the cover to translate to a first cover position, covering the opening of the laser module (similar to those described above).

While the above description illustrates some example safety mechanisms, as mentioned, the scope of the present disclosure is not limited to these mechanisms.

Figure 4A:
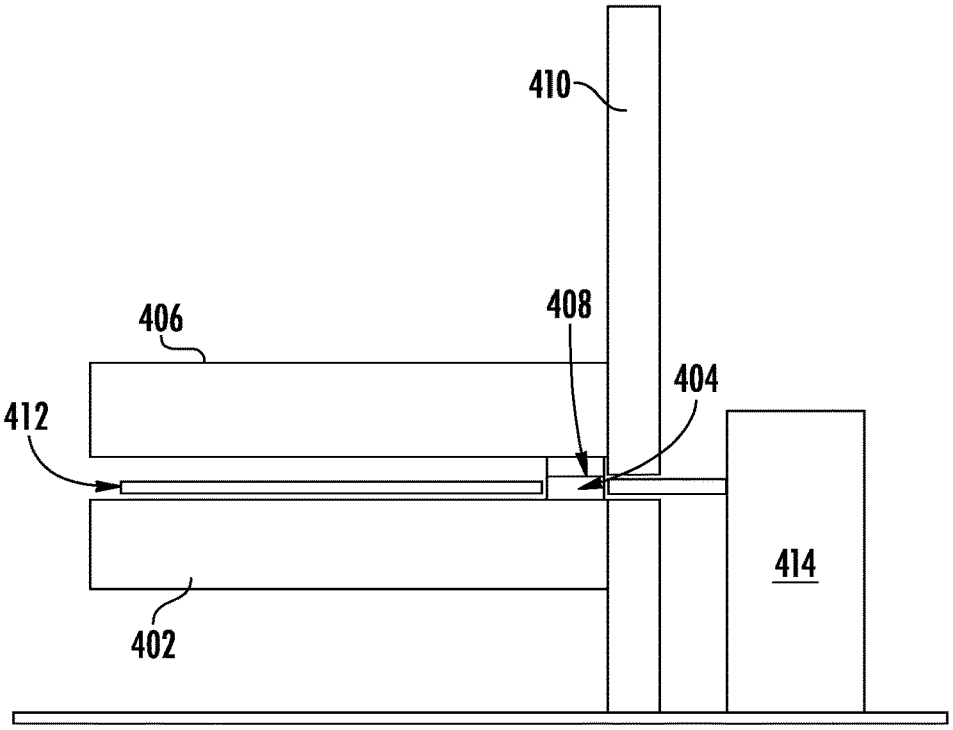
FIG. 4A schematically depicts an example block diagram of an example laser printer where a power contact may be in contact with a power receptacle according to various embodiments of the present disclosure.
Figure 4B:
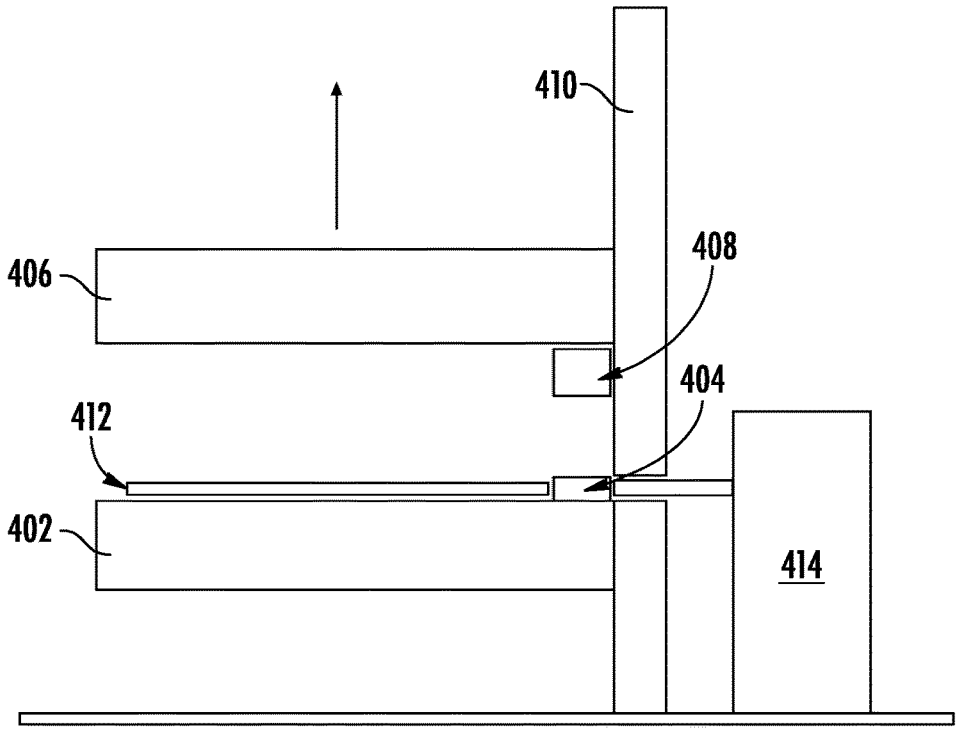
FIG. 4B schematically depicts an example block diagram of an example laser printer where a power contact may be disconnected from a power receptacle according to various embodiments of the present disclosure.

Referring now to FIG. 4A and FIG. 4B, example safety mechanisms for a printing apparatus are illustrated. In many laser printers, power may be supplied to the laser module by means of wire harness from a power supply (or other power board) to a power connector of the top chassis portion. However, when the laser module is powered on, there is a risk that the laser module may accidentally release a laser beam and cause laser-related accidents and/or injuries. To address these issues, FIG. 4A and FIG. 4B illustrate example safety mechanisms for disconnecting a power supply from the laser module.

Referring now to FIG. 4A, the bottom chassis portion 402 may comprise a power contact 404 disposed on a top surface of the bottom chassis portion 402. As shown in FIG. 4A, the power contact 404 may be coupled to a power supply unit 414. Examples of a power supply unit may include, but not limited to, internal and/or external power sources, such as batteries, power outlets, and/or the like. In some examples, the power contact 404 may be coupled to the power supply unit 414 via a wire harness that passes through the back-spine section 410.

In some examples, the power contact 404 may comprise material with conductivity characteristic, such as copper, steel, and/or the like. In some examples, the power contact 404 may comprise at least one spring-loaded pin for conducting electricity to, for example, a power receptacle.

In the example shown in FIG. 4A, the top chassis portion 406 may comprises a power receptacle 408 disposed on a bottom surface of the top chassis portion 406. In some examples, the power receptacle 408 may be coupled to a laser module of the laser printer, such that the power receptacle 408 may conduct electricity to the laser module.

In particular, as shown in FIG. 4A, when the top chassis portion 406 is positioned at the bottom point of the travel path, the power receptacle 408 of the top chassis portion 406 may be coupled to the power contact 404 of the bottom chassis portion 402. For example, the power receptacle 408 may be coupled to the power contact 404 via pogo pin and/or latch. Additionally, or alternatively, the power receptacle 408 may be in direct contact with the power contact 404. Because the power contact 404 is coupled to the power supply unit 414, electricity may be conducted to the laser module from the power supply unit 414 and via the power contact 404 and the power receptacle 408. In some examples, the laser module may be powered on and activated, and may cause texts, graphics and/or the like to be printed on the print media 412.

In some examples, when the top chassis portion 406 is not positioned at the bottom point of the travel path, the power receptacle 408 of the top chassis portion 406 may not be coupled to the power contact 404 of the bottom chassis portion 402. Referring now to FIG. 4B, such an example is shown. As shown in FIG. 4B, when the top chassis portion 406 travels up along the travel path, the power receptacle 408 is separated from the power contact 404. As such, the laser module is not powered on and cannot emit any laser beam. By physically separating the power receptacle from the power contact, there is no possibility for power to flow to the laser module and/or for the laser module to generate a laser beam when the top chassis portion is lifted-up, which may reduce and/or eliminate the risks of laser-related accidents and/or injuries.

Figure 5:
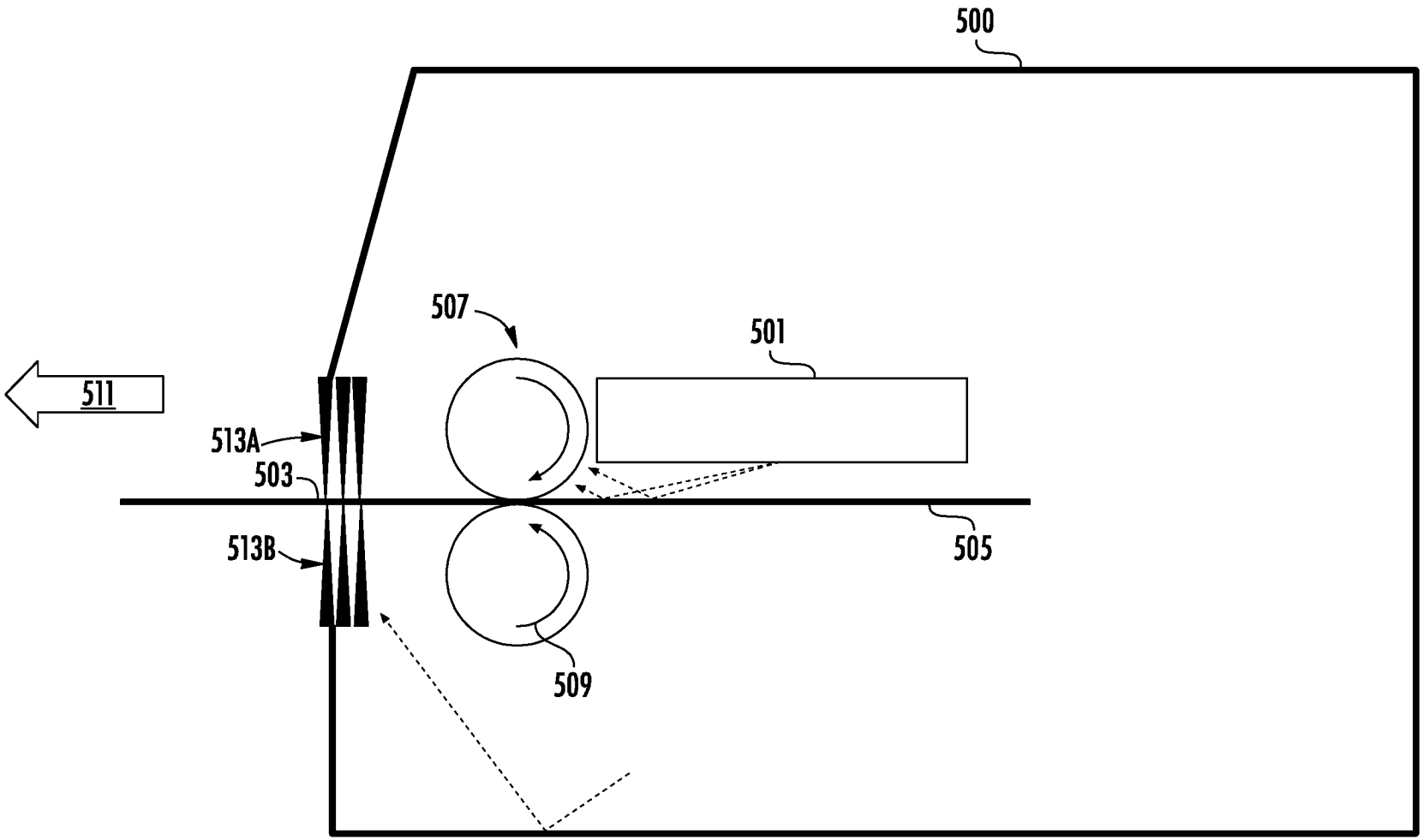
FIG. 5 schematically depicts an example block diagram showing example components of an example laser printer that may include at least one brush element according to various embodiments of the present disclosure.

Referring now to FIG. 5, example safety mechanisms for a printing apparatus are illustrated. In particular, FIG. 5 illustrates example safety mechanisms where one or more brush elements may be implemented.

In some examples, a laser printer may comprise a printer cover connected to a printer body. The printer cover and the printer body may form a printer casing that houses the top chassis portion and comprises an exit slit for a print media. Referring now to FIG. 5, an example printer casing 500 is illustrated. As shown in FIG. 5, the printer casing 500 may house the top chassis portion 501 and comprise an exit slit 503. The print media 505 may exit from the printer casing 500 via the exit slit 503 after texts, graphics and/or the like are printed on the print media 505.

As shown in FIG. 5, there is a risk that a laser beam may escape from the top chassis portion 501 (as shown by the dashed arrows). In some examples, at least one platen roller may be positioned after the top chassis portion 501 in a print direction of a print media 505. In some examples, the at least one platen roller may be disposed on a first surface of a back-spine section, similar to the top chassis portion 501.

In the example shown in FIG. 5, the at least one platen roller may comprise a top platen roller 507 and a bottom platen roller 509. The print media 505 may travel between the top platen roller 507 and the bottom platen roller 509 in the print direction 511. The top platen roller 507 and the bottom platen roller 509 may comprise material that may comply with industrial standard requirement for laser absorption. In some examples, each of the widths of the top platen roller 507 and the bottom platen roller 509 may correspond to the width of the print media 505. As such, to the extent that laser beams may escape from the top chassis portion 501, the top platen roller 507 and the bottom platen roller 509 may block and absorb such laser beams at least along a width of the print media 505.

Additionally, or alternatively, one or more brush elements may be implemented to block and/or absorb laser beams. For example, at least one brush element may be disposed on an inner surface of the printer casing 500, and may be positioned after the top chassis portion 501 and before the exit slit 503 in the print direction 511 of the print media 505. In the example shown in FIG. 5, the at least one brush element may comprise a top brush element 513A and a bottom brush element 513B. The print media 505 may travel between the top brush element 513A and the bottom brush element 513B in the print direction 511, and may exit the printer casing 500 via the exit slit 503. In some examples, the top brush element 513A and the bottom brush element 513B may comprise material that may comply with industrial standard requirement for laser absorption, similar to those described above in connection with the safety cover of FIG. 2A and FIG. 2B. For example, while the top brush element 513A and the bottom brush element 513B may be flexible enough to let the print media 505 pass through, their material may have enough density to block all the light (including laser beams), and therefore may provide a safe printing environment for a user.

Figure 6:
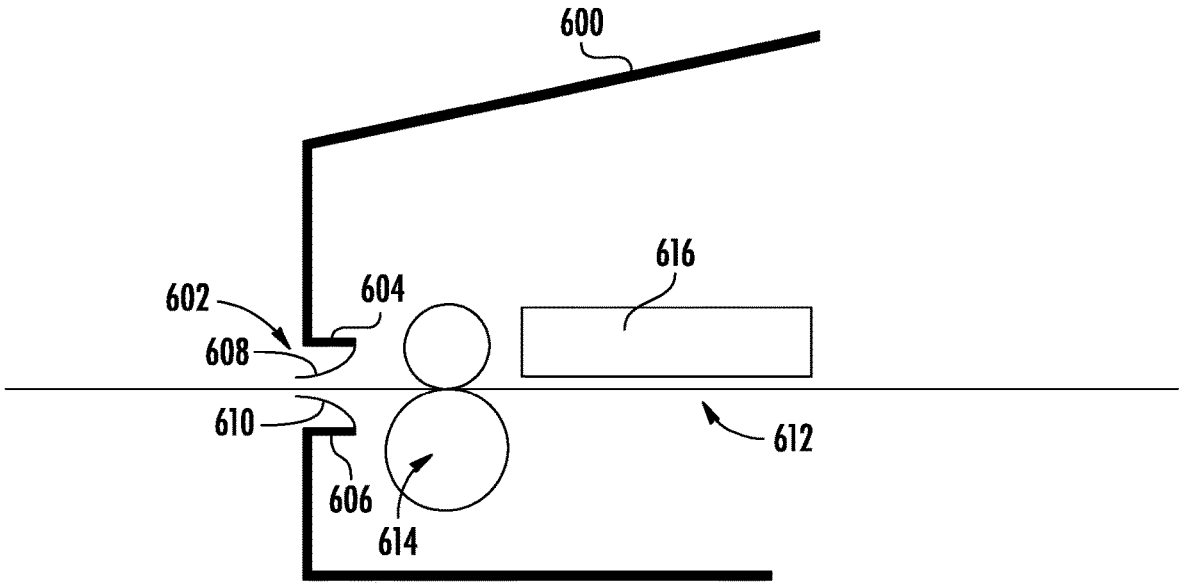
FIG. 6 schematically depicts an example block diagram showing example components of an example laser printer that may include at least one guide-way element and at least one rib element according to various embodiments of the present disclosure.

Referring now to FIG. 6, example safety mechanisms for a printing apparatus are illustrated. In particular, FIG. 6 illustrates example safety mechanisms where one or more rib elements may be implemented.

Comparing FIG. 6 with FIG. 5, the exit slit 602 of the printer casing 600 may comprise at least one guide-way element (for example, a top guide-way element 604 and a bottom guide-way element 606). The term "guide-way element" may refer to a structure that may extend from an inner surface or an outer surface of the printer casing around the exit slit. For example, the top guide-way element 604 and/or the bottom guide-way element 606 may extend perpendicular from an inner surface of the printer casing 600 around the exit slit 602. In some examples, implementing a guide-way element may reduce or eliminate printer jam.

In the example shown in FIG. 6, at least one rib element may be connected to the at least one guide-way element. The term "rib element" may refer to a structure that may extend from an edge of a guide-way element and may curve towards the center of the exit slit. For example, a top rib element 608 may be connected to the top guide-way element 604, and a bottom rib element 610 may be connected to the bottom guide-way element 606. In some examples, after texts, graphics and/or the like after printed on the print media 612 utilizing the laser module in the top chassis portion 616, the print media 612 may travel between the top rib element 608 and the bottom rib element 610 (for example, driven by the drive roller 614), and may exit the printer casing 600 through the exit slit 602.

In some examples, the top rib element 608 and the bottom rib element 610 may comprise material that may comply with industrial standard requirement for laser absorption, similar to those described above in connection with the safety cover of FIG. 2A and FIG. 2B. As such, the top rib element 608 and the bottom rib element 610 may reduce and/or block laser beams from escaping from the printer casing 600.

Figure 7A:
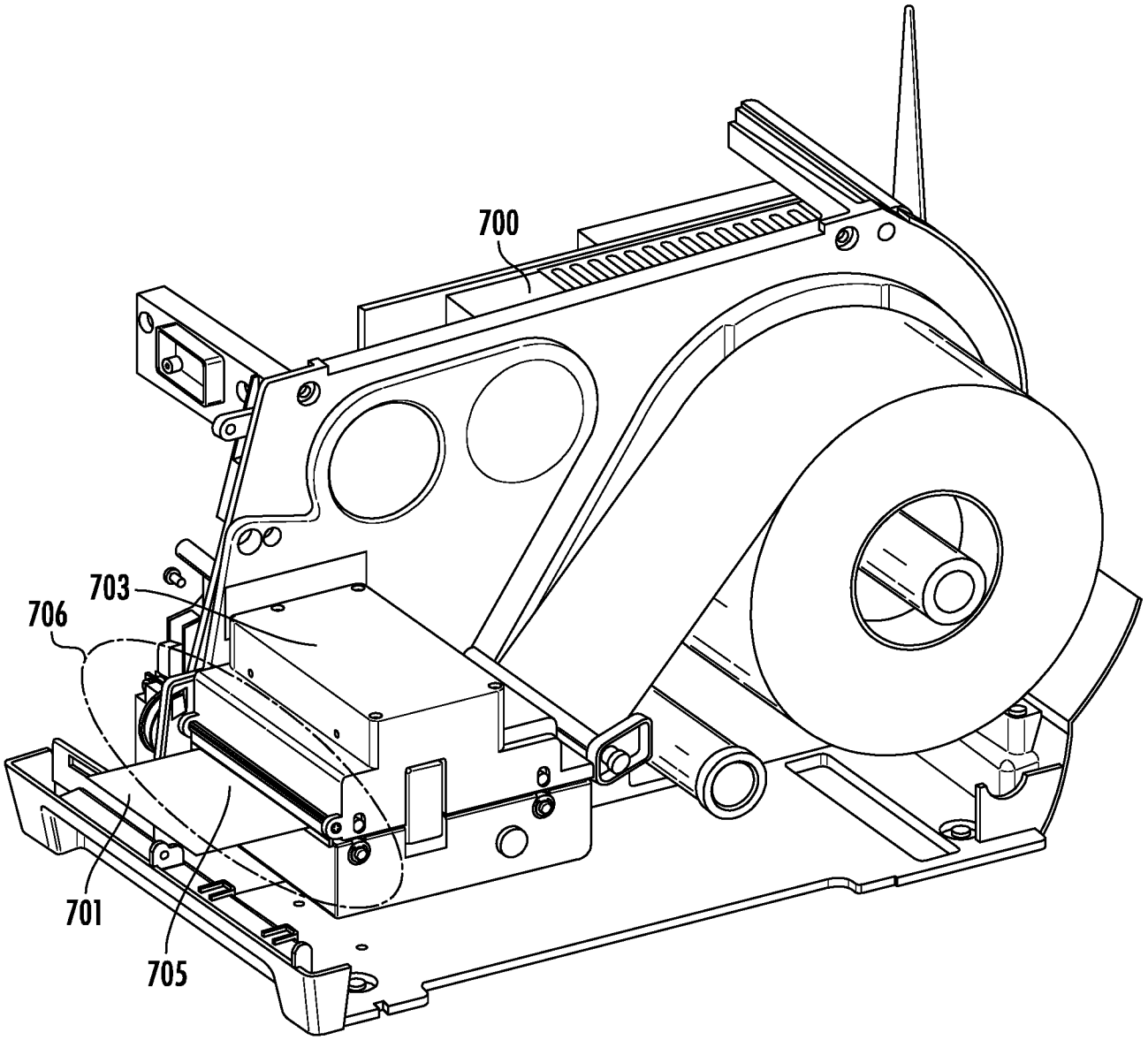
FIG. 7A schematically depicts an example perspective view of an example laser printer that may include at least one plate element according to various embodiments of the present disclosure.
Figure 7B:
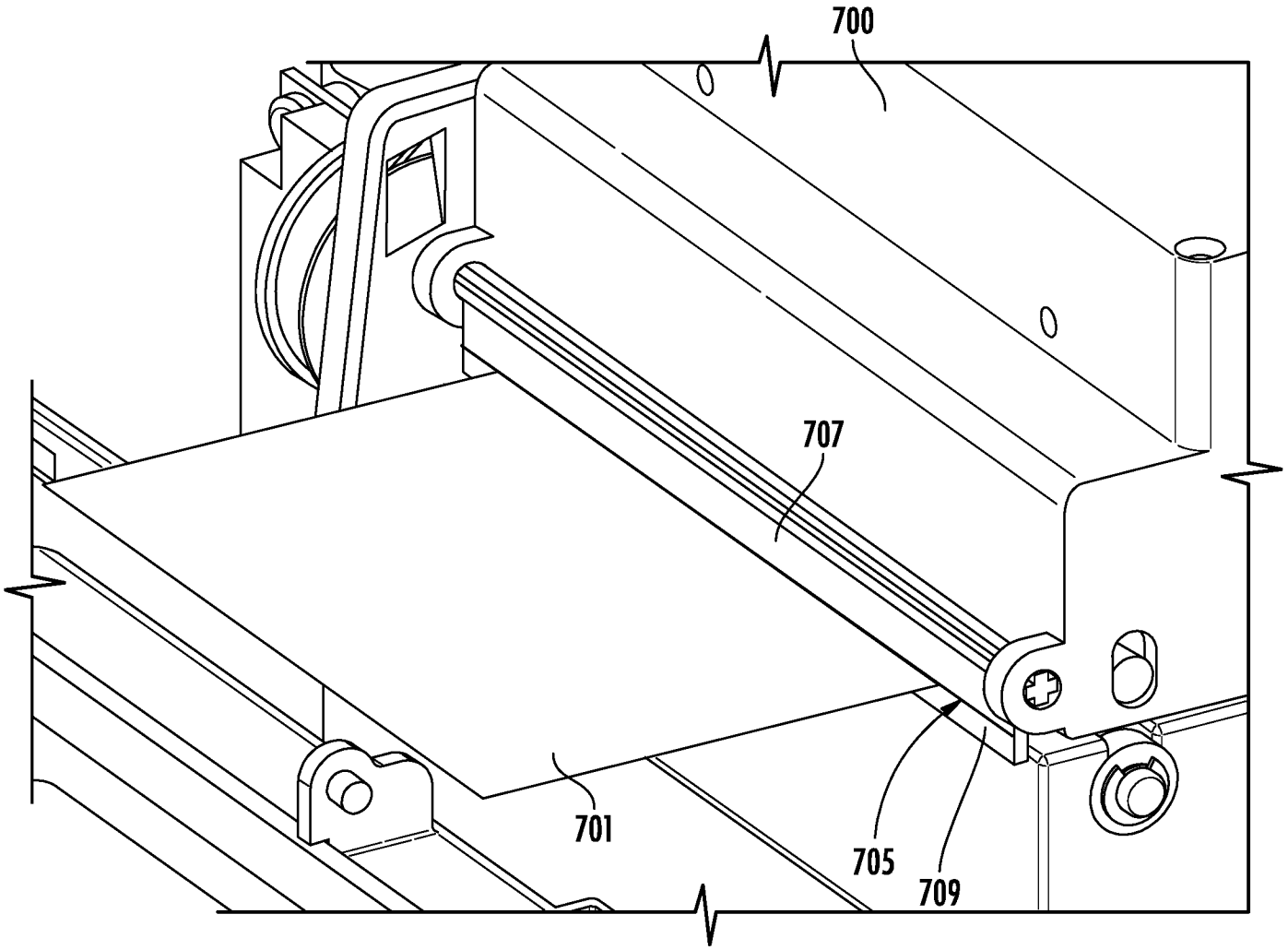
FIG. 7B schematically depicts an example zoomed view of a portion 705 of the example laser printer shown in FIG. 7A according to various embodiments of the present disclosure.

Referring now to FIG. 7A and FIG. 7B, example safety mechanisms for a printing apparatus are illustrated. In particular, FIG. 7A and FIG. 7B illustrate example safety mechanisms where one or more plate elements may be implemented.

Referring now to FIG. 7A, a partial view of an example printing apparatus 700 is illustrated. The printing apparatus 700 may comprise a top chassis portion 703, similar to the top chassis portion 123 described above in connection with FIG. 1A and FIG. 1B. For example, the top chassis portion 703 may comprise a laser module that may cause texts, graphics and/or the like to be printed on the print media 701. The print media 701 may exit from the printing apparatus 700 from an exit slit 705.

Referring now to FIG. 7B, a zoomed view of area 706 of the example printing apparatus 700 in FIG. 7A is illustrated.

In some examples, an exit slit may comprise at least one plate element disposed on an outer surface of the printer casing through a hinge mechanism. In the example shown in FIG. 7B, the at least one plate element may comprise a top plate element 707 and a bottom plate element 709. In some examples, the top plate element 707 and the bottom plate element 709 may each be connected to the printer casing through a hinge mechanism. The print media 701 may travel between the top plate element 707 and the bottom plate element 709 to exit from the printing apparatus 700. Because of the hinge mechanism, the top plate element 707 and the bottom plate element 709 may swivel up/down and open the exit slit 705 along their corresponding hinge axes only when the print media exits from the printing apparatus 700.

In some examples, the top plate element 707 and the bottom plate element 709 may comprise material that may comply with industrial standard requirement for laser absorption, similar to those described above in connection with the safety cover of FIG. 2A and FIG. 2B. As such, laser beams may be blocked and/or absorbed by the top plate element 707 and the bottom plate element 709.

Figure 8A:
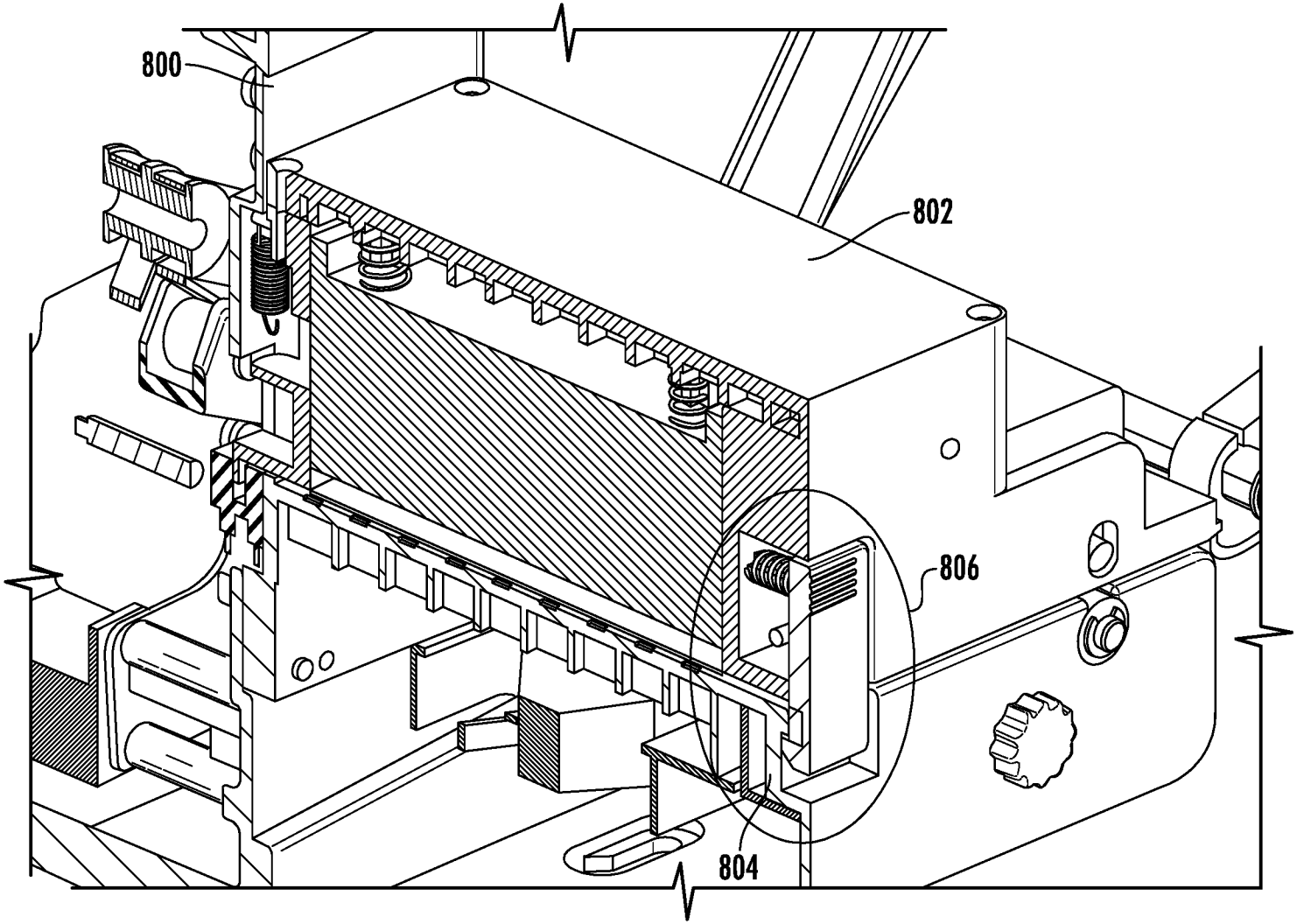
FIG. 8A schematically depicts an example perspective view of an example laser printer that may include a latch hook element and a latch notch element according to various embodiments of the present disclosure.
Figure 8B:
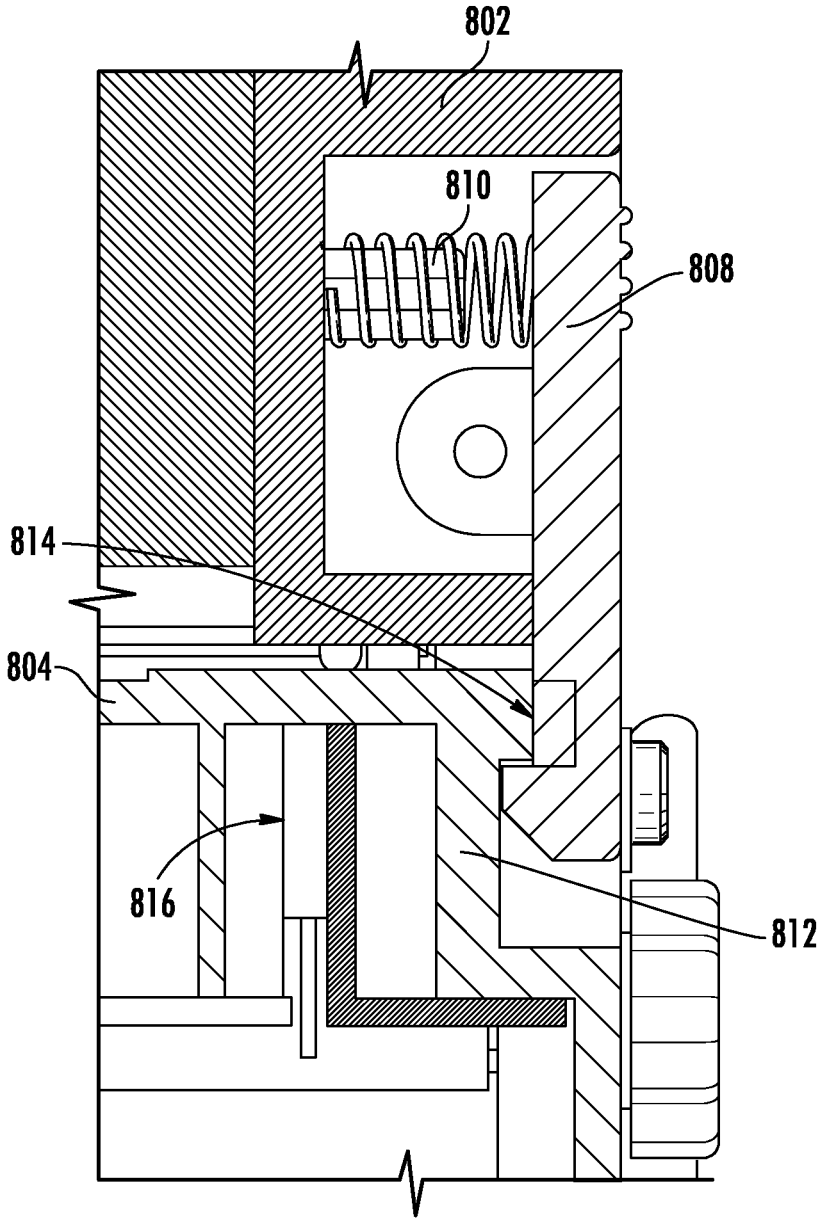
FIG. 8B schematically depicts an example zoomed view of a portion 804 of the example laser printer shown in FIG. 8A according to various embodiments of the present disclosure.

Referring now to FIG. 8A and FIG. 8B, example safety mechanisms for a printing apparatus is illustrated. In particular, FIG. 8A and FIG. 8B illustrate example safety mechanisms where one or more magnetic switch elements may be implemented.

Referring now to FIG. 8A, a partial view of an example printing apparatus 800 is illustrated. The printing apparatus 800 may comprise a top chassis portion 802, similar to the top chassis portion 123 described above in connection with FIG. 1A and FIG. 1B. The printing apparatus 800 may comprise a bottom chassis portion 804, similar to the bottom chassis portion 127 described above in connection with FIG. 1A and FIG. 1B.

Referring now to FIG. 8B, a zoomed view of area 806 of the example printing apparatus 800 in FIG. 8A is illustrated.

In some examples, a latch hook element may be connected to an outer surface of the top chassis portion through a bias spring, and the latch hook element may be configured to engage a latch notch element disposed on an outer surface of the bottom chassis portion when the top chassis portion is positioned at the bottom point of the travel path. In the example shown in FIG. 8B, a latch hook element 808 may be connected to an outer surface of the top chassis portion 802 through a bias spring 810. When the top chassis portion 802 is positioned at the bottom point of the travel path, the latch hook element 808 may be configured to engage with the latch notch element 812 disposed on an outer surface of the bottom chassis portion 804. In other words, the latch hook element 808 and the latch notch element 812 may provide an interlock mechanism to ensure that the top chassis portion 802 is securely positioned when the laser module emits a laser beam to cause texts, graphics and/or the like to be printed on the print media.

In some examples, the latch hook element 808 may comprise a magnetic element 814 (for example but not limited to, a ferrite magnet) disposed on a surface of the latch hook element 808 or within the latch hook element 808. In some examples, the bottom chassis portion 804 may comprise a magnetic switch element 816 (for example but not limited to, a hall effect magnetic switch) disposed on an inner surface of the bottom chassis portion 804 or within the bottom chassis portion 804. The magnetic switch element 816 may be electronically coupled to a power supply unit, and/or may function as switch to turn the power supply unit on or off. For example, the magnetic switch element 816 may be configured to detect a magnetic field strength, and may compare the magnetic field strength with a threshold value. Based on whether the magnetic field strength exceeds the threshold value, the magnetic switch element 816 may turn the power supply unit on or off.

In some examples, the magnetic field strength detected by the magnetic switch element 816 may correspond to a distance between the top chassis portion 802 and the bottom chassis portion 804. When the top chassis portion 802 is positioned at the bottom point of the travel path (as shown in FIG. 8B), the magnetic field strength detected by the magnetic switch element 816 may exceed the threshold value. In such examples, the magnetic switch element 816 may switch on the power supply unit, such that the power supply unit may supply power to the laser module in the top chassis portion 802. In some examples, when the top chassis portion 802 is not at the bottom point of the travel path, the magnetic field strength detected by the magnetic switch element 816 may not exceed the threshold value. In such examples, the magnetic switch element 816 may switch off the power supply unit, such that the power supply unit may not supply power to the laser module in the top chassis portion 802.

As such, by implementing a magnetic switch element to control the supply of power to the laser module based on the distance between the top chassis portion and the bottom chassis portion, examples of the present disclosure may prevent the laser module from being powered on when the top chassis portion is not positioned at the bottom point of the travel path and in a "ready to print" state.

While the examples described above include implementing various example safety mechanisms for a printing apparatus through hardware means, it is noted that the scope of the present disclosure is not limited to hardware means only. Examples of the present disclosure may be implemented, for example, through a combination of hardware means and software means (for example, a controller executing programming instructions).

Figure 9:
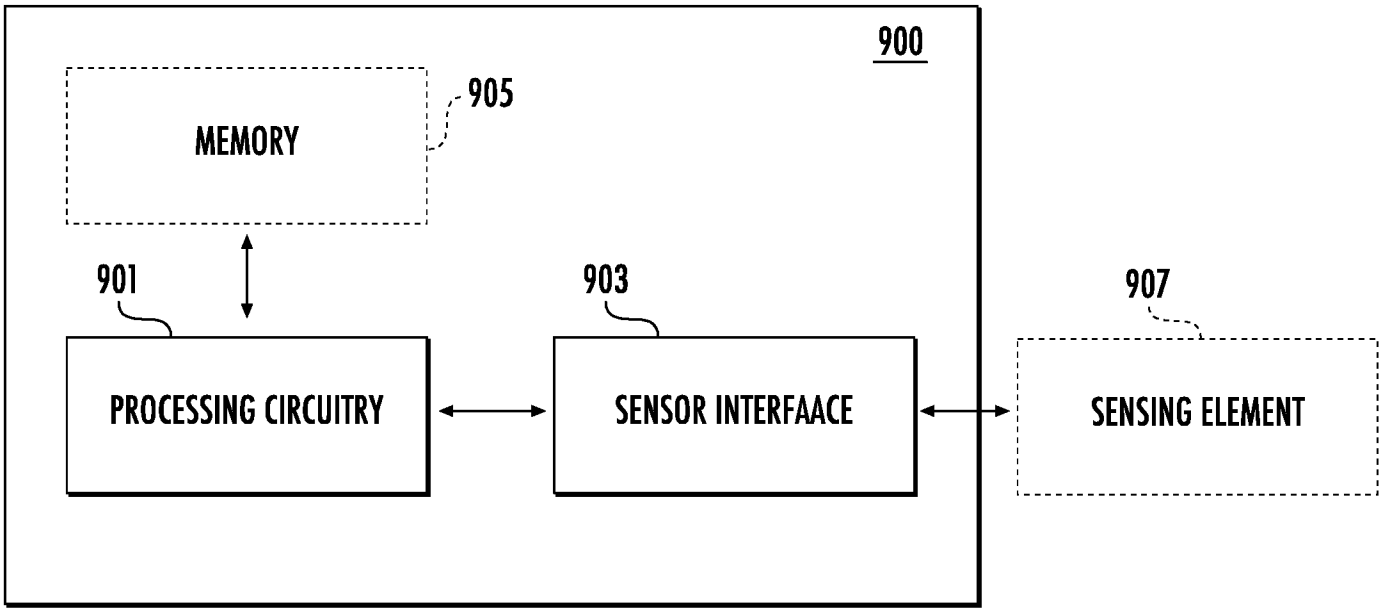
FIG. 9 schematically depicts an example block diagram showing example components of an example controller that may be electronically coupled to one or more sensing elements associated with an example laser printer according to various embodiments of the present disclosure.

Referring now to FIG. 9, an example block diagram illustrating various components of an example controller 900 in accordance with examples of the present disclosure is shown. For example, the example controller 900 may comprise at least one processing circuitry (such as a processing circuitry 901) and/or a sensor interface 903. In some examples, the example controller 900 may comprise a memory 905. Although these components may be described with respect to functional limitations, it should be understood that the particular implementations necessarily include the use of particular hardware. It should also be understood that certain of these components may include similar or common hardware.

In some examples, the processing circuitry 901 may be embodied in a number of different ways. For example, the processing circuitry 901 may be a micro-processing circuitry. As another example, the processing circuitry 901 may be a general-purpose processor.

The processing circuitry 901 may process data and control one or more sensing elements that are connected to the controller. In some examples, the processing circuitry 901 may process sensing data received from the one or more sensing elements, and may transmit control signals to one or more power sources for the laser module, details of which are described herein. In some examples, the processing circuitry 901 may be in communication with the memory 905 integrated within the example controller 900. In some examples, the processing circuitry 901 may be in communication with a memory that is external to the example controller 900.

Referring back to FIG. 9, the sensor interface 903 may be configured to enable the example controller 900 to be electronically coupled to and communicate with at least one sensing element (such as the sensing element 907). In some examples, the sensor interface 903 may be any means such as a device or circuitry embodied in either hardware or a combination of hardware and software that is configured to receive and/or transmit data from/to a network and/or other device, circuitry, or module (such as sensing element(s)) in communication with the controller. In some examples, the sensor interface 903 may include, for example, a network interface for enabling communications with a wired or wireless communication network. For example, the sensor interface 903 may include one or more network interface cards, antennae, buses, switches, routers, modems, and supporting hardware and/or software, or any other device suitable for enabling communications via a network. Additionally, or alternatively, the sensor interface 903 may include the circuitry for interacting with the antenna/antennae to cause transmission of signals via the antenna/antennae or to handle receipt of signals received via the antenna/antennae.

In some examples, additional elements of the controller may provide or supplement the functionality of particular circuitry. For example, additional processor(s) may provide processing functionality, additional memory(s) may provide storage functionality, additional transceivers may communicate data to and from other devices, and/or the like.

Figure 10:
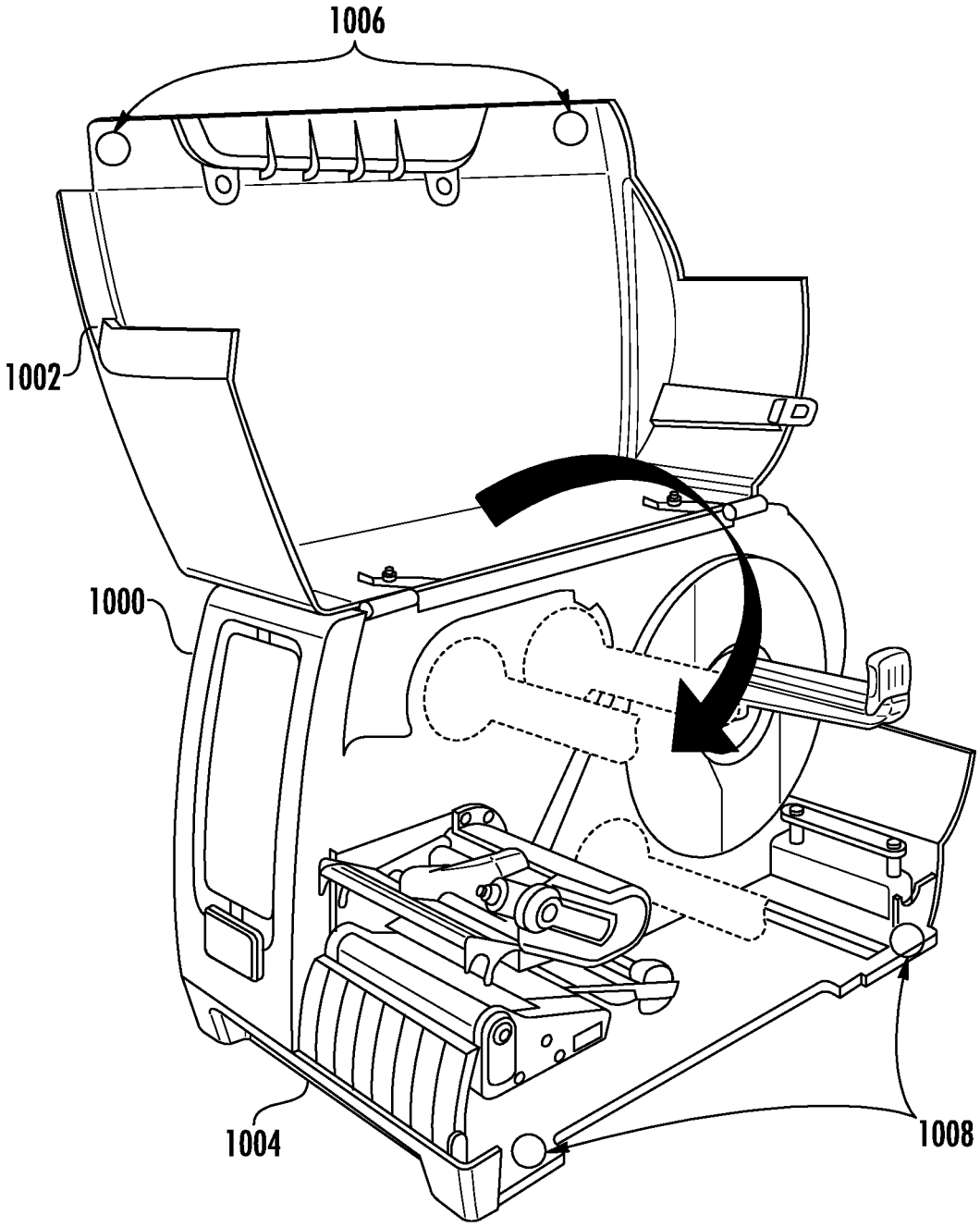
FIG. 10 schematically depicts an example perspective view of an example laser printer when the example laser printer is in an open state according to various embodiments of the present disclosure.

Referring now to FIG. 10, example safety mechanisms for an example printing apparatus 1000 are illustrated.

In the example shown in FIG. 10, the example printing apparatus 1000 may comprise a printer cover 1002 and a printer body 1004. The printer cover 1002 may be connected to the printer body 1004 through one or more hinge mechanisms.

In some examples, at least one magnetic element 1006 may be disposed on an inner surface of the printer cover 1002. For example, the at least one magnetic element 1006 may be disposed along a bottom edge of the printer cover 1002.

In some examples, at least one magnetic sensing element 1008 may be disposed on an inner surface of the printer body 1004. For example, the at least one magnetic sensing element 1008 may be disposed along a bottom edge of the printer body 1004. The at least one magnetic sensing element 1008 may include, for example, but not limited to, one or more hall effect sensors.

In some examples, the at least one magnetic sensing element 1008 may be configured to generate sensing data indicative of a distance between the at least one magnetic element 1006 and the at least one magnetic sensing element 1008, similar to those described above in connection with FIG. 8A and FIG. 8B. The at least one magnetic sensing element 1008 may transmit sensing data to a controller (for example, the example controller 900 illustrated and described above in connection with FIG. 9) that is electronically coupled to the at least one magnetic sensing element 1008.

In some examples, the controller may determine whether the distance between the at least one magnetic element 1006 and the at least one magnetic sensing element 1008 exceeds a threshold value. For example, the threshold value may correspond to the distance between the at least one magnetic element 1006 and the at least one magnetic sensing element 1008 when the example printing apparatus 1000 is in a closed state (i.e. when the printer cover 1002 and the printer body 1004 form a closed enclosure).

In some examples, in response to determining that the distance exceeds the threshold value, the controller may cause the power supply unit to be turned off. In other words, when the example printing apparatus 1000 is in an open state (for example, as shown in FIG. 10), the controller may cause the power supply unit to be turned off, such that the laser module may not emit laser beams, and that potential laser beam leakage may be prevented. In some examples, in response to determining that the distance does not exceed the threshold value (i.e. the printing apparatus 1000 is in a closed state), the controller may cause the power supply unit to be turned on.

While FIG. 10 and the description above illustrate example types of sensing elements and example positions of these elements, it is noted that the scope of the present disclosure is not limited to these particular types/positions. In some examples, other types of sensors and/or other locations may be utilized. For example, reflective sensors may be positioned on the inner surface of the printer cover 1002 (which may generate sensing data indicating a reflected light received by printer cover 1002). When the sensing data indicating that there is reflected light (i.e. the example printing apparatus 1000 is in an open state), a controller (electronically coupled to the reflective sensors) may cause the power supply unit to be turned off.

In the specification and figures, typical embodiments of the disclosure have been disclosed. The present disclosure is not limited to such exemplary embodiments. The use of the term "and/or" includes any and all combinations of one or more of the associated listed items. The figures are schematic representations and so are not necessarily drawn to scale. Unless otherwise noted, specific terms have been used in a generic and descriptive sense and not for purposes of limitation.

The foregoing detailed description has set forth various embodiments of the devices and/or processes via the use of block diagrams, flow charts, schematics, exemplary, and examples. Insofar as such block diagrams, flow charts, schematics, and examples contain one or more functions and/or operations, each function and/or operation within such block diagrams, flowcharts, schematics, or examples can be implemented, individually and/or collectively, by a wide range of hardware thereof.

In one embodiment, examples of the present disclosure may be implemented via Application Specific Integrated Circuits (ASICs). However, the embodiments disclosed herein, in whole or in part, can be equivalently implemented in standard integrated circuits, as one or more computer programs running on one or more computers (e.g., as one or more programs running on one or more computer systems), as one or more programs running on one or more processing circuitries (e.g., micro-processing circuitries), as one or more programs running on one or more processors (e.g., microprocessors), as firmware, or as virtually any combination thereof.

In addition, those skilled in the art will appreciate that example mechanisms disclosed herein may be capable of being distributed as a program product in a variety of tangible forms, and that an illustrative embodiment applies equally regardless of the particular type of tangible instruction bearing media used to actually carry out the distribution. Examples of tangible instruction bearing media include, but are not limited to, the following: recordable type media such as floppy disks, hard disk drives, CD ROMs, digital tape, flash drives, and computer memory.

The various embodiments described above can be combined with one another to provide further embodiments. For example, two or more of example embodiments described above may be combined to, for example, improve the safety of laser printing and reduce the risks associated with laser-related accidents and injuries. These and other changes may be made to the present systems and methods in light of the above detailed description. Accordingly, the disclosure is not limited by the disclosure, but instead its scope is to be determined by the following claims.

The invention claimed is:

1. A printing apparatus, comprising:

a top chassis portion;

a bottom chassis portion positioned under the top chassis portion in a vertical axis and configured to receive print media;

a latch hook element fastened to an outer surface of the top chassis portion;

a latch notch element disposed on an outer surface of the bottom chassis portion;

a sensor coupled to the bottom chassis portion and configured to generate a signal indicative of whether the latch hook element is coupled to the latch notch element; and a power supply unit configured to supply a power to a laser module within the top chassis portion, wherein the power supply unit switches off the power supplied to the laser module based on the signal.

2. The printing apparatus of claim 1, wherein the latch notch element engages with the latch hook element when the top chassis portion is positioned at a bottom point of a travel path for the top chassis portion in the vertical axis.

3. The printing apparatus of claim 1, wherein the latch hook element is coupled to the outer surface of the top chassis portion through a bias spring.

4. The printing apparatus of claim 1, wherein the latch hook element comprises a magnetic element disposed on a surface of the latch hook element.

5. The printing apparatus of claim 1, wherein the sensor coupled to the bottom chassis portion comprises a magnetic switch element disposed on an inner surface of the bottom chassis portion.

6. The printing apparatus of claim 5, wherein the magnetic switch element comprises a hall effect magnetic switch.

7. The printing apparatus of claim 5, wherein the magnetic switch element is electronically coupled to the power supply unit.

8. The printing apparatus of claim 7, wherein the magnetic switch element is configured to:

detect a magnetic field strength of a magnetic element disposed on a surface of the latch hook element;

compare the magnetic field strength with a threshold value;

in response to the comparison, perform one of:

switch on the power supply unit when the magnetic field strength exceeds the threshold value; and switch off the power supply unit when the magnetic field strength does not exceed the threshold value.

9. The printing apparatus of claim 8, wherein the magnetic field strength detected by the magnetic switch element corresponds to a distance between the top chassis portion and the bottom chassis portion.

10. The printing apparatus of claim 1, wherein the top chassis portion is coupled to at least one linear guide disposed on a first surface of a back-spine section of a printer body, wherein the top chassis portion comprises a laser safety casing, wherein the laser safety casing comprises the laser module configured to emit a laser beam along a laser path and a safety cover that is moveable to a first cover position intersecting the laser path to block the laser beam from escaping from the laser safety casing;

wherein the laser safety casing comprises a cover control mechanism connected to the safety cover, wherein the cover control mechanism causes the safety cover to:

translate to the first cover position when the top chassis portion is not positioned at a bottom point of a travel path for the top chassis portion; and translate to a second cover position away from the laser path when the top chassis portion is positioned at the bottom point.

11. The printing apparatus of claim 10, wherein the at least one linear guide defines the travel path for the top chassis portion in the vertical axis.

12. The printing apparatus of claim 10, wherein the cover control mechanism comprises at least one bias spring connected to the safety cover and the at least one linear guide.

13. The printing apparatus of claim 12, wherein:

when the top chassis portion is positioned at the bottom point, the at least one bias spring causes the safety cover to translate to the second cover position, and when the top chassis portion is not positioned at the bottom point, the at least one bias spring causes the safety cover to translate to the first cover position.

14. The printing apparatus of claim 1, further comprising:

a printer cover connected to a printer body, the printer cover and the printer body forming a printer casing that houses the top chassis portion and comprises an exit slit for the print media.

15. The printing apparatus of claim 14, wherein the exit slit comprises at least one plate element disposed on an outer surface of the printer casing.

16. The printing apparatus of claim 15, wherein the at least one plate element comprises a top plate element and a bottom plate element.

17. The printing apparatus of claim 16, wherein the top plate element and the bottom plate element comprise laser absorbing material.

18. The printing apparatus of claim 14, further comprising:

at least one brush element disposed on an inner surface of the printer casing and positioned after the top chassis portion and before the exit slit in a print direction of the print media.

19. The printing apparatus of claim 18, wherein the at least one brush element comprises a top brush element and a bottom brush element, wherein the print media travels between the top brush element and the bottom brush element in the print direction.

20. The printing apparatus of claim 19, wherein the top brush element and the bottom brush element comprise laser absorbing material.

* * * * *